US011268355B2

(12) United States Patent
Xu et al.

(10) Patent No.: US 11,268,355 B2
(45) Date of Patent: Mar. 8, 2022

(54) METHODS AND SYSTEMS FOR HANGING STRUCTURES IN DOWNHOLE ENVIRONMENTS

(71) Applicants: Zhiyue Xu, Cypress, TX (US); Guijun Deng, The Woodlands, TX (US); Oleksandr Kuznetsov, Manvel, TX (US); Deepak Kumar, Houston, TX (US)

(72) Inventors: Zhiyue Xu, Cypress, TX (US); Guijun Deng, The Woodlands, TX (US); Oleksandr Kuznetsov, Manvel, TX (US); Deepak Kumar, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 60 days.

(21) Appl. No.: 16/809,858

(22) Filed: Mar. 5, 2020

(65) Prior Publication Data

US 2021/0277751 A1 Sep. 9, 2021

(51) Int. Cl.
*E21B 43/10* (2006.01)
*E21B 17/08* (2006.01)

(52) U.S. Cl.
CPC ..... *E21B 43/106* (2013.01); *E21B 17/08* (2013.01)

(58) Field of Classification Search
CPC ..... E21B 43/106; E21B 17/08; E21B 17/02; E21B 17/041; E21B 19/16; F16L 9/14; F16L 13/08
See application file for complete search history.

(56) References Cited

U.S. PATENT DOCUMENTS

| | | | | |
|---|---|---|---|---|
| 7,640,965 | B2 | 1/2010 | Bosma et al. | |
| 9,016,324 | B2 * | 4/2015 | Niccolls | B32B 27/28 138/140 |
| 10,301,914 | B2 | 5/2019 | Zhao et al. | |
| 10,352,109 | B2 | 7/2019 | Sanchez | |
| 2015/0152691 | A1 * | 6/2015 | Di Crescenzo | F16L 13/08 285/289.5 |
| 2019/0195062 | A1 * | 6/2019 | Espe | E21B 33/134 |

FOREIGN PATENT DOCUMENTS

| | | | |
|---|---|---|---|
| EP | 1443175 | A1 | 8/2004 |
| WO | 2019097252 | A2 | 5/2019 |

OTHER PUBLICATIONS

Welch, William R. et al., "Nonelastomeric Sliding Sleeve Maintains Long Term Integrity in HP/HT Application: Case Histories", SPE Eastern Regional Meeting, Oct. 23-25, 1996, Columbus Ohio, 1 page.

* cited by examiner

*Primary Examiner* — Kristyn A Hall
(74) *Attorney, Agent, or Firm* — Cantor Colburn LLP

(57) ABSTRACT

Downhole hanger systems and methods for hanging a first structure from a second structure in downhole environments are described. The systems include a first structure and a second structure, with the first structure disposed within the second structure. A composite joint is arranged on an outer surface of the first structure. The composite joint is formed of a material configured to be fused to both the first structure and the second structure and form a hanger joint having a shear strength of at least 2 ksi when the material is fused to the outer surface of the first structure and an inner surface of the second structure.

20 Claims, 7 Drawing Sheets

METHODS AND SYSTEMS FOR HANGING STRUCTURES IN DOWNHOLE ENVIRONMENTS

BACKGROUND

Boreholes are drilled deep into subsurface formations for many applications, such as carbon dioxide sequestration, geothermal production, and hydrocarbon exploration and production. In all of the applications, the boreholes are drilled such that they pass through or allow access to a material (e.g., a gas or fluid) contained in a formation located below the Earth's surface. Once the boreholes have been drilled, such boreholes may require gravel packing to prevent sand or other debris from being extracted from a formation during production.

Establishing and maintaining contact integrity between liner hangers and a base casing has long been one of the most problematic areas facing operators involved in downhole operations. Current liner hanger systems, e.g., mechanical liner hangers, hydraulic liner hangers, balanced cylinders liner hangers, expandable liner hangers, etc. suffer from complex designs (e.g., including both liner-top packer and liner hanger) and, potentially, low reliability, adding additional costs during both manufacturing and maintenance (e.g., during their lifecycle). Most importantly, as oil and gas production activities continue to shift toward more hostile and unconventional environments, such as reservoirs with extremely high pressure-high temperature (HPHT) conditions, corrosive sour environments (e.g., high in hydrogen sulfide and carbon dioxide), materials and components that provide sealing in liner-top packers may begin to decompose when temperature approach 600° F. Such decomposition of material may cause safety and environmental risks, which may limit the ability for heavy oil exploration.

An additional factor impacting liner hangers is the requirement for high load capabilities. The load imposed upon the hanger liner may be exceptionally high, and when factored with other environmental conditions, can lead to problematic systems. Accordingly, there is a need for a simple and rugged downhole joining designs to connect a liner with a hanger in hostile downhole environments.

SUMMARY

Downhole hanger systems and methods for hanging a first structure from a second structure in downhole environments are described. The systems include a first structure and a second structure, with the first structure disposed within the second structure. A composite joint is arranged on an outer surface of the first structure. The composite joint is formed of a material configured to be fused to both the first structure and the second structure and form a hanger joint having a shear strength of at least 2 ksi when the material is fused to the outer surface of the first structure and an inner surface of the second structure.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Disclosed are methods and systems for hanging one structure from another structure in downhole environments. In accordance with some embodiments, methods and systems for hanging a first structure (e.g., a liner) to a second structure (e.g., a casing) in an oil well or other borehole are described. A composite hanger joint is arranged between the first structure and the second structure. In accordance with some embodiments, the methods and systems employ a surface energy source which is delivered to the hanger joint location in the well several thousand feet from the Earth's surface and used to fuse the composite material and form a strong composite hanger joint between the first and second structures. In accordance with some embodiments, the same energy source can be used to make an energized M-M seal to replace a traditional elastomer top hanger packer or other traditional seal. Advantageously, embodiments of the present disclosure may eliminate the need for conventional setting tools, provides simplified designs to reduce cost and risks, can provide high loading capacity joints and all typical functionality of convention joints.

Figure 1:
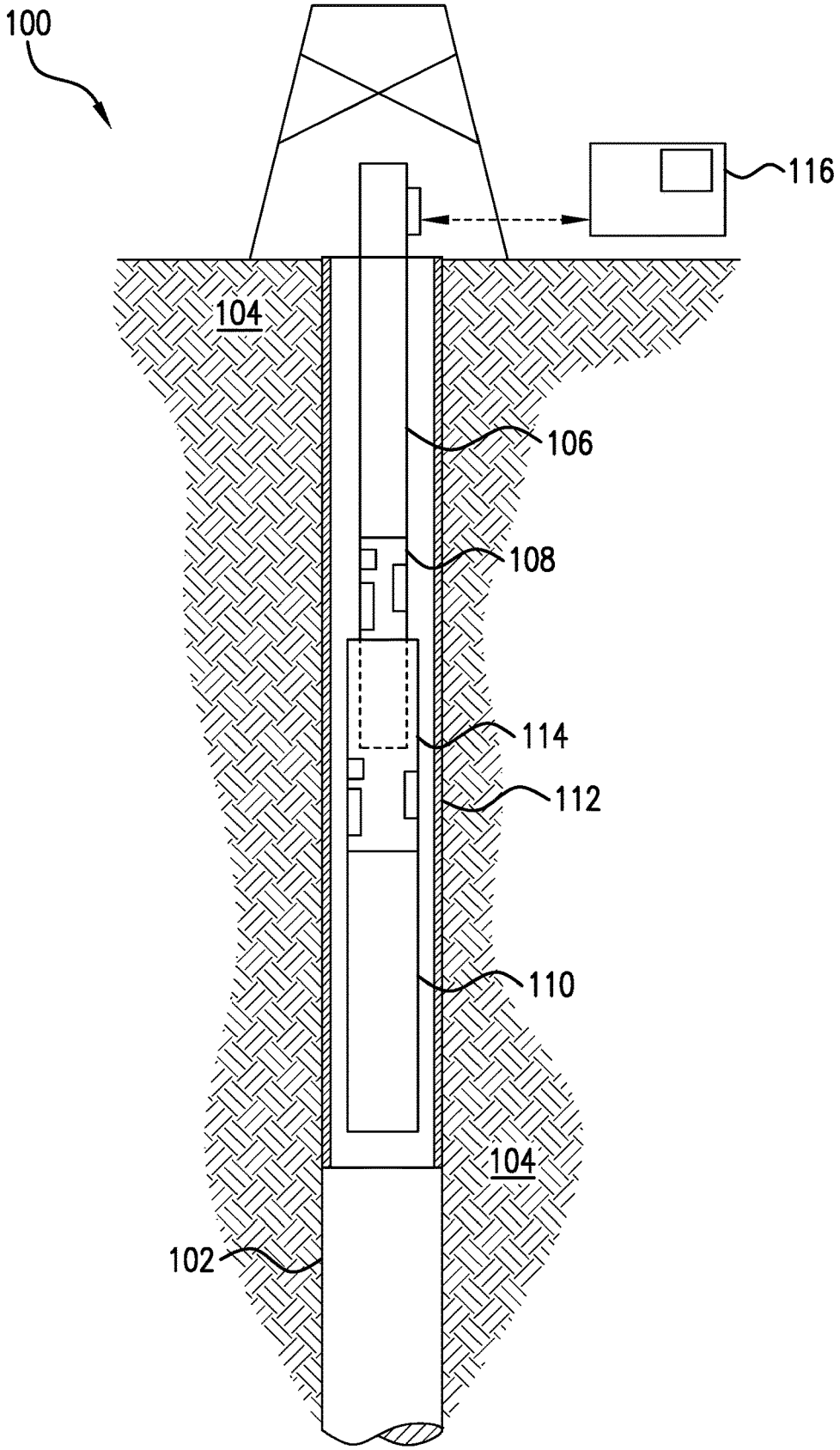
FIG. 1 depicts a downhole hanger system that can incorporate embodiments of the present disclosure.

Referring to FIG. 1, a schematic illustration of an embodiment of a system 100 for production of downhole resources (e.g., oil, gas, hydrocarbons, etc.) through a borehole 102 passing through an earth formation 104 that can employ embodiments of the present disclosure is shown. The system 100 includes a work string 106 disposed within the borehole 102. The work string 106, in some embodiments, includes a plurality of string segments or, in other embodiments, is a continuous conduit such as a coiled tube, and in some embodiments may be a drill string. As described herein, "string" refers to any structure or carrier suitable for lowering a tool or other component through a borehole, and is not limited to the structure and configuration illustrated herein. The term "carrier" as used herein means any device, device component, combination of devices, media, and/or member that may be used to convey, house, support, or otherwise facilitate the use of another device, device component, combination of devices, media, and/or member. Example, non-limiting carriers include, but are not limited to, casing pipes, wirelines, wireline sondes, slickline sondes, drop shots, downhole subs, and bottomhole assemblies.

In this illustrative embodiment, the system 100 includes a running tool 108 configured to perform a liner hanging of a liner 110 to a casing 112 that cases part of the borehole 102. The running tool 108 includes one or more tools or components to facilitate liner hanging. In some configurations, a float shoe (not shown) may be arranged at an end of the work string 106 and may be arranged proximate a toe of the borehole 102. A liner hanger 114 may be employed, as will be appreciated by those of skill in the art. The liner hanger 114 is configured to be engageable with the interior surface or inner diameter surface of the casing 112 and support and hang the liner 110 within the borehole 102. A surface unit 116 may be operably connected to and in communication with the running tool 108 to enable remote control and operation of the running tool 108 and thus hang the liner 110 from the casing 112 using the liner hanger 114.

The liner hanger, in typical configurations and operations, may be a conventional hanger that employs a slip mechanism. In such systems, mechanical slips are used to grip the inside of the casing a pre-determined distance above a casing shoe. The space between the liner hanger and the casing shoe is called the liner lap. Liner hangers can be set hydraulically, mechanically, or a mixture of the two. Typically, the liners are cemented back to the liner hanger. These mechanical slip mechanisms may suffer from various drawbacks, including, but not limited to, complex designs (e.g., including both liner-top packer and liner hanger) and, potentially, low reliability, adding additional costs during both manufacturing and maintenance (e.g., during their lifecycle). Further, in hostile and unconventional environments, such as reservoirs with extremely high pressure-high temperature (HPHT) conditions and/or corrosive sour environments (e.g., high in hydrogen sulfide and carbon dioxide), the materials and components that provide sealing and connection of the mechanical slip hangers may begin to decompose when temperatures approach 600° F. Such decomposition of material may cause safety and environmental risks, which may limit the ability for heavy oil exploration. An additional factor impacting liner hangers is the requirement for high load capabilities. The load imposed upon the hanger liner may be exceptionally high, and when factored with other environmental conditions, can lead to problematic systems (e.g., failure of the slips or other mechanical components of the hanger). Accordingly, there is a need for a simple and rugged downhole joining designs to connect a liner with a hanger in hostile downhole environments.

Disclosed herein are methods and systems to hang a liner to a casing in a borehole (e.g., oil well) through use of a composite hanger joint between the liner and the casing. In accordance with some embodiments described herein, the methods employ a surface energy source which is delivered to the hanger joint location in the borehole. Such hanger joint may be located several thousand feet from the Earth's surface, and thus a reliable energy delivery system for activating and/or engaging the hanger joint is provided herein. The delivered energy is used to fuse a composite material and form a strong composite hanger joint to thus hang the liner to a casing. In some embodiments, a surface energy source can be used to make an energized metal-to-metal seal (M-M seal) which may replace a traditional elastomer top hanger packer. That is, in addition to forming a hanger joint, embodiments described herein may be configured to form a seal proximate a hanger joint. Advantageously, embodiments described herein can eliminate the need for conventional setting tools, presents a relatively simplified design which can reduce cost and risk (i.e., eliminate relatively complex setting systems), may provide for high loading capacity and full basic functions expected of typical hanger joints, and enables use of a high power efficiency, low attenuation energy source.

In accordance with some embodiments described herein, the systems and methods include a surface energy source, a means to deliver the energy (e.g., a waveguide, optical fiber, or wireline for electric current), a downhole processing head, and a purging unit. Example, surface energy sources that may be used in various embodiments, without limitation, are a millimeter wave (MMW) gyrotron and a fiber laser or kilowatt laser beam source. The MMW can be delivered with minor power loss through an internal inner diameter of a drilling string, carrier, or work string. In some embodiments, the use of high power optical fiber cable can be configured to deliver a kilowatt laser beam over a long distance with low power loss (e.g., ~0.01 Db/km, or 1% loss over 3000 feet). A downhole high energy application head is arranged downhole as part of the tool and is configured to direct, shape, and deliver an energy wave to a target surface to form the hanger joint. The downhole high energy application head is attached to the work string and can move up and down (e.g., longitudinally relative to a borehole axis) or rotate (e.g., rotational movement driven by the rotation of the work string). Such movement may be performed by movement of the work string or by other mechanisms as known in the art (e.g., an independent actuator that translates and rotates the downhole high energy application head). As used herein, "high energy" may refer to frequency ranges of between about 30 to about 300 GHz, wavelength ranges between about 1 mm to about 10 mm, and/or megawatt power.

The above introduced and below described composite hangers are non-mechanical, and thus non-slip or slipless hanger configurations. Such slipless hanger configurations, as described herein, provide for relatively simple and reliable methods to hang a liner to a casing (or joining or two downhole components) that can reduce costs and operational risks. Further, advantageously, such slipless systems may improve and/or increase hanging capacity. Furthermore, advantageously, such slipless systems may provide for improved sealing and thus reduction of risks and effects associated with hostile and unconventional environments. These systems eliminate the need for conventional setting tools and enables remote and on-demand operation of the formation of a hanger joint.

Figure 2A:
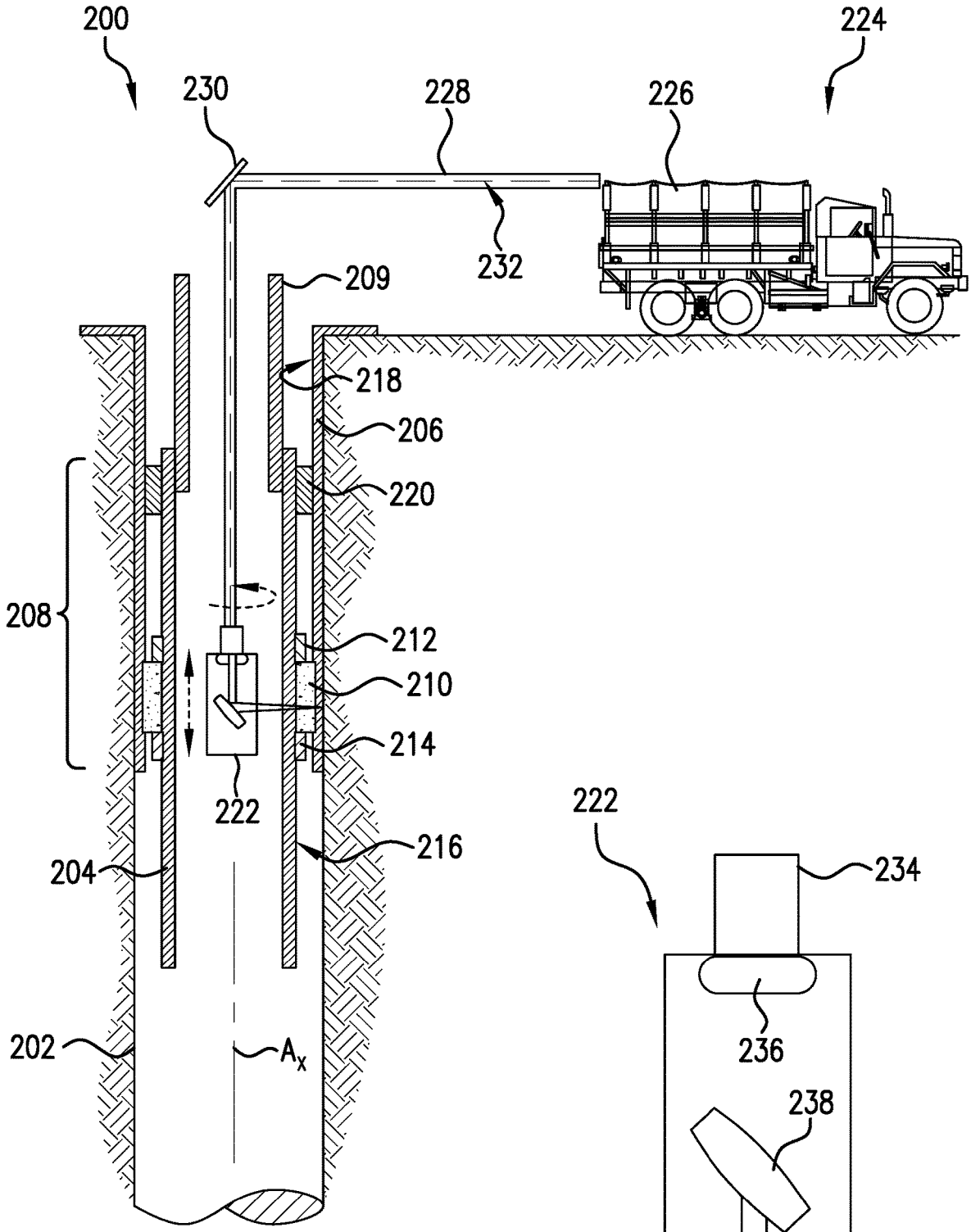
FIG. 2A depicts downhole hanger system in accordance with an embodiment of the present disclosure.
Figure 2B:
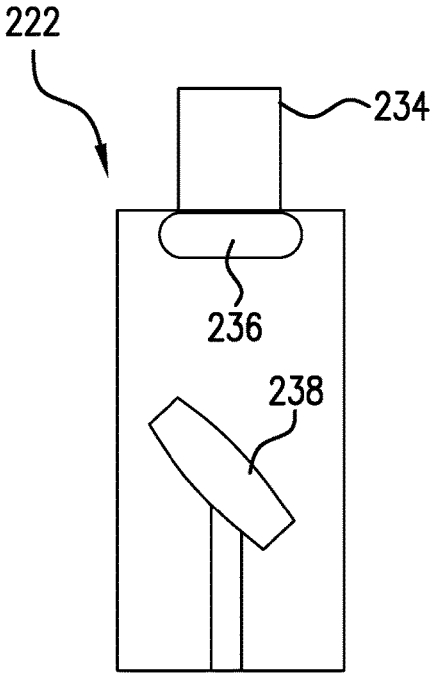
FIG. 2B illustrates an enlarged portion of the downhole hanger system of FIG. 2A.

Turning to FIGS. 2A-2B, a schematic illustration of a system 200 in accordance with an embodiment of the present disclosure is shown. FIG. 2A illustrates schematically the system 200 as disposed within a borehole 202 and FIG. 2B illustrates an enlarged illustration of a portion of the system 200. As in a typical downhole hanging operation, a first structure 204 (e.g., a liner) is disposed within a second structure 206 (e.g., casing, outer liner, etc.) and arranged be hung from the second structure 206. The second structure 206 may encase a portion of the borehole 202, as shown. The first structure 204 is conveyed downhole through the second structure 206 and is configured to be mounted to or otherwise attached to an end of the second structure 206 by a downhole hanger system 208. The first structure 204 may be lowered through the second structure 206 by a work string 209, as known in the art. Although shown and described with respect to a casing-liner arrangement, it will be appreciated that embodiments of the present disclosure may be applied and used for joining any components of downhole systems and tools that may require a strong joint or connection, which is formed downhole (e.g., after deployment downhole). As such, the first and second structures described herein are not merely limited to casings and liners, but rather can be any two joinable or connectable components in downhole systems. The illustrative embodiment is provided merely for explanatory and illustrative purposes to inform those of skill in the art.

The downhole hanger system 208 includes a composite joint 210, a body lock ring 212 arranged uphole from the composite joint 210, and a retaining ring 214 arranged downhole from the composite joint 210. The composite joint 210, the body lock ring 212, and the retaining ring 214 are disposed on an outer diameter or outer surface 216 of the first structure 204 and arranged to enable contact and engagement with an inner diameter or inner surface 218 of the second structure 206. The body lock ring 212 and the retaining ring 214 are configured to support and retain the composite joint 210 to the first structure 204 during conveyance through the second structure 206. In this illustrative embodiment, the downhole hanger system 208 further includes a seal 220 at an uphole end of the downhole hanger system 208 (i.e., at a position closer to the Earth's surface than the composite joint 210). The composite joint 210 is formed of a material that may be fused by application of high energy to cause a joint to form between the outer surface 216 of the first structure 204 and the inner surface 218 of the second structure 206. That is, the composite joint 210 does not provide a joint or engagement between the first structure 204 and the second structure 206 until high energy is applied thereto. The composite joint 210 may, for example and without limitation, be made from metallic alloys, metal composites with ceramic or other reinforcement particles, or a polymeric composite system. The composite joint 210 is configured to join two metallic surfaces (e.g., the outer surface 216 of the first structure 204 and the inner surface 218 of the second structure 206).

As such, the composite joint may be made up of, for example, mixing materials which react to provide heat energy (e.g., via exothermic reaction such as aluminum-nickel oxide, titanium-boron, aluminum-iron oxide, aluminum-coper oxide, aluminum-bismuth oxide, combinations of these materials, etc.) and joining filler (e.g., tin-, silver-, cadmium-, or lead-based solder material, and/or iron- or nickel-based alloy as joining material) which melt or semi-melt and fuse to join the first structure 204 to second structure 206. In some configurations, the composite joint 210 may include a joining flux, such as ammonium chloride, boron oxide, silicon oxide, or aluminum oxide, to increase a strength of the formed joint. The material of the composite joint, in accordance with embodiments of the present disclosure, has a lower melting point than the material of the first and second structures (e.g., liner and casing), and thus the material of the composite joint will melt and fuse with the material of the first and second structures. It will be appreciated that the mixing materials which react to provide heat energy may be referred to as an exothermic reactant and the joining filler may be referred to as a solder or braze material.

In some embodiments, material of the composite joint may be selected to have specific properties. For example, the material of the composite joint may be selected to have a strength of greater than 2,000 psi at service temperatures of 200-300° F. Further, the material of the composite joint may be selected such that the required thermal energy to activate and form a bond does not exceed the melting temperature of the structures to be joined (e.g., not to exceed about 1,000° F.). Furthermore, the material of the composite joint may be selected to have negative thermal expansion and may be selected to be compatible with cement and completions fluids (e.g., no or low corrosion, etc.). In some configurations, a braze material may be pre-deposited on the surfaces of the first and second structures at the location of the composite joint, which may further increase the joint strength. Such braze materials may include, without limitation, copper, nickel, etc. In some non-limiting, but specific, examples, the braze material may have the following compositions: Sn-7.5Bi-2Ag-0.5Cu; Sn-25Ag-10Sb; 89Bi-11Ag-0.05Ge; 50Ag-16Cu-17Zn-18Cd; 95Cd-5Ag; or HMP (high melting point) solder.

To cause the composite joint 210 to melt, bond, adhere, fuse, or otherwise join the outer surface 216 of the first structure 204 and the inner surface 218 of the second structure 206, a downhole high energy application head 222 is disposed downhole. The downhole high energy application head 222 is part of a surface-based, downhole high energy application system 224. The surface-based, downhole high energy application system 224 includes a high energy source 226, a high energy delivery device 228, and the downhole high energy application head 222. The high energy source 226 may be configured to generate, for example, high energy laser or millimeter wave (MMW) energy that be distributed downhole through or along the high energy delivery device 228 to the downhole high energy application head 222. The high energy delivery device 228 may be a fiber, such as an optical fiber, wave guide, or other high power delivery wire, cable, or other structures and devices as known in the art. Alternatively, electric current (or wireline) may be employed as a method of triggering a composite material for in-situ joining.

The downhole high energy application system 224 can include, in at least one non-limiting configuration, a laser unit, a high power optical fiber, an optical downhole process head, and a downhole beam guider. Further, a purging and/or debris removal system may be included. The high energy delivery device 228 may further include processing, monitoring, and control elements, such as a control computer or similar control electronics. In fiber optic configurations, a fused silica fiber may be employed having an attenuation of laser power of about 0.3-0.12 dB/km or a non-oxide optical fiber may be employed having an attenuation of laser power of about 0.001 dB/km. In a MMW configuration, electromagnetic radiation having a frequency range of between about 30 to about 300 GHz or about 1 mm to about 10 mm wavelength may be employed. Such MMW systems may provide efficient, long distance, guided megawatt transmission.

As shown in FIG. 2A, one or more energy reflectors 230 (e.g., mirrors) may be arranged to direct a high energy beam 232 from the high energy source 226 to the downhole high energy application head 222. As shown in FIG. 2B, the downhole high energy application head 222 includes an adapter 234 arranged on a distal end of the high energy delivery device 228, the adapter 234 configured to attach the high energy delivery device 228 to the downhole high energy application head 222. The downhole high energy application head 222 includes a beam collimate lens 236 and a beam focus lens 238. The high energy beam 232 will be directed through the beam collimate lens 236 and incident to the beam focus lens 238, which will then direct the high energy beam 232 upon the material of the composite joint 210. As the high energy beam 232 interacts with the material of the composite joint 210, the material will be heated and fuse, thus causing a joint or bond to form between the material of the composite joint 210, the material of the outer surface 216 of the first structure 204 and the material of the inner surface 218 of the second structure 206.

The downhole high energy application head 222 may be moveable about a tool axis $A_x$. The tool axis $A_x$ may be defined through a longitudinal central axis of the work string 209 and/or the first structure 204. The movement of the downhole high energy application head 222 may be both axially (e.g., up and down on the page of FIG. 2A) and rotationally (e.g., about the tool axis AO, with such movement indicated by the dashed-arrow lines in FIG. 2A. The movement of the downhole high energy application head 222 allows for a controlled application of the high energy beam 232 to be applied to the material of the downhole hanger system 208 to join the first structure 204 to the second structure 206 and thus form a downhole hanger joint.

The seal 220, in some embodiments, may be a packer, as will be appreciated by those of skill in the art. However, in alternative embodiments, the seal 220 may be formed from a material similar to that of the composite joint 210 or other material which may be caused to form a seal by application of the high energy beam 232. In some embodiments, the material of the seal 220 is different from that of the composite joint 210. For example, the material of the composite joint 210 may be selected based on physical properties related to load carrying capability and bonding between the outer surface 216 of the first structure 204 and the inner surface 218 of the second structure 206. In contrast, the material of the seal 220 may be selected for properties related to fluid impermeability and thus form a fluid seal between the outer surface 216 of the first structure 204 and the inner surface 218 of the second structure 206, but may not require load bearing capabilities. Example material that may be used for the seal 220, in the high energy application configuration, include, but are not limited to those described above and herein with respect to forming the composite joint.

Figure 3A:
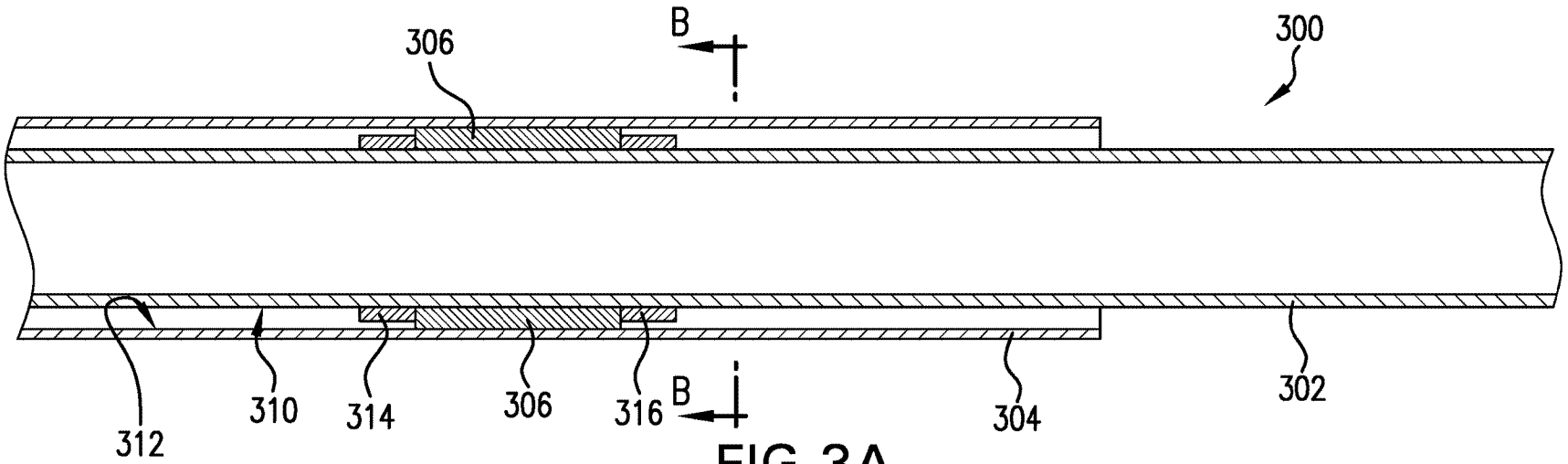
FIG. 3A illustrates a side cross-sectional illustration of a portion of a downhole hanger system in accordance with an embodiment of the present disclosure.
Figure 3B:
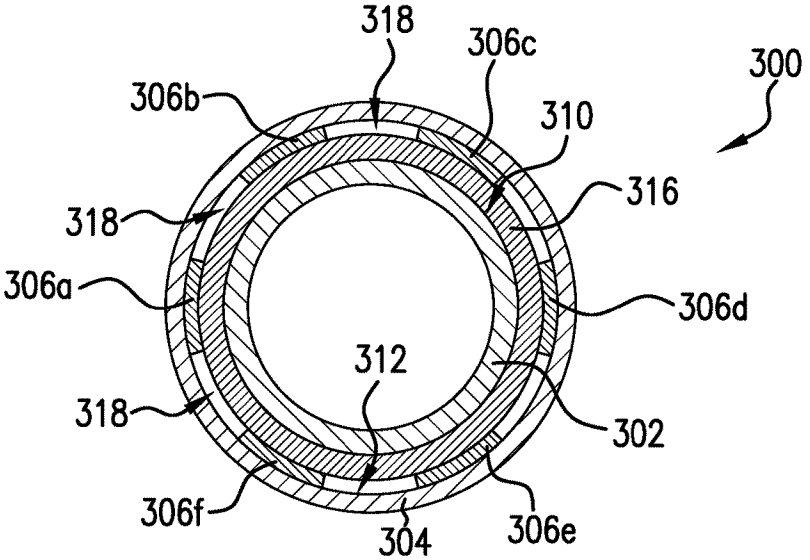
FIG. 3B illustrates a cross-sectional illustration of the downhole hanger system of FIG. 3A, as viewed along the line B-B.

Turning now to FIGS. 3A-3B, schematic illustrations of a downhole hanger system 300 in accordance with an embodiment of the present disclosure are shown. FIG. 3A is a side cross-sectional view of the downhole hanger system 300 and FIG. 3B is a cross-sectional view of the downhole hanger system 300 as viewed along the line B-B of FIG. 3A. As shown, a first structure 302 is arranged relative to a second structure 304, with the first structure 302 configured to be attached to or hung from the second structure 304 by a composite joint 306. The composite joint 306 may be formed of material as described above and may be activated by application of high energy, as described above. The composite joint 306 is arranged on an outer surface 310 of the first structure 302 and is able to be joined to an inner surface 312 of the second structure 304. The material of the composite joint 306 may be held in place on the first structure 302 by a body lock ring 314 and a retaining ring 316.

As shown in FIG. 3B, the composite joint 306 may be formed of multiple discrete elements, parts, or portions (labeled 306*a-f* in FIG. 3B) arranged about the outer surface 310 of the first structure 302. The discrete elements 306*a-f* may be arranged or spaced equally about the circumference of the first structure 302. Between circumferentially adjacent discrete elements 306*a-f* may be spaces 318. The spaces 318 may be provided to allow a fluid flow across the composite joint 306 (e.g., completion fluid and/or cement). As noted and described above, uphole or above the composite joint 306 may be a seal that can provide fluid sealing proximate the composite joint 306. When high energy is applied to the composite joint 306, as described above, the composite joint 306 may fuse with the second structure 304 and the first structure 302.

In some embodiments of the present disclosure, the material of the composite joint(s) may be pre-fused to the first structure prior to being run downhole. Alternatively, in some embodiments, the material of the composite joint may be fused to both the first structure and the second structure during a single downhole operation by application of high energy (e.g., laser or MMW) from a surface-based high energy source.

Embodiments described herein are advantageous because they can provide for a high load capacity while being relatively simple in terms of construction and implementation. For example, in some embodiments of the present disclosure, the material of the composite joint may be configured to fuse and form a joint between a first structure and a second structure having a shear strength of 2 ksi or greater (2 kilopound per square inch). One such example may be a shear strength of 4 ksi or greater. Based on this example shear strength (4 ksi), the surface area of the outer surface of the first structure covered by the material of the composite joint may be selected to support a given load. For example, by using six elements or sections of composite joint arranged in a 5×7 liner hanger (i.e., 5 in liner size, 7 inch casing size), greater than 250,000 lbs may be a supported hanging load.

As such, when fused between the first structure and the second structure, the formed fused-composite joint may have a shear strength of at least 2 ksi. However, in other embodiments, higher shear strength may be achieved, based on the specific composite material configuration and composition. The material, as noted above, may be selected to join two metallic surfaces (e.g., the first structure and the second structure). The composite joint is made up of a composition from mixing materials which react to provide heat energy (e.g., via exothermic reaction such as aluminum-nickel oxide, titanium-boron, aluminum-iron oxide, aluminum-coper oxide, aluminum-bismuth oxide, combinations of these materials, etc.) and a joining filler (e.g., tin-, silver-, cadmium-, or lead-based solder material, and/or iron- or nickel-based alloy as joining material) which melt or semi-melt and fuse to join the two metallic components. In some configurations, the composite joint of the present disclosure may include a joining flux, such as ammonium chloride, boron oxide, silicon oxide, or aluminum oxide, to increase a strength of the formed joint. The material of the composite joint, in accordance with embodiments of the present disclosure, is selected to have a lower melt point than the material of the two metal components, and thus the material of the composite joint will melt and fuse with the material of the metal components.

Figure 4:
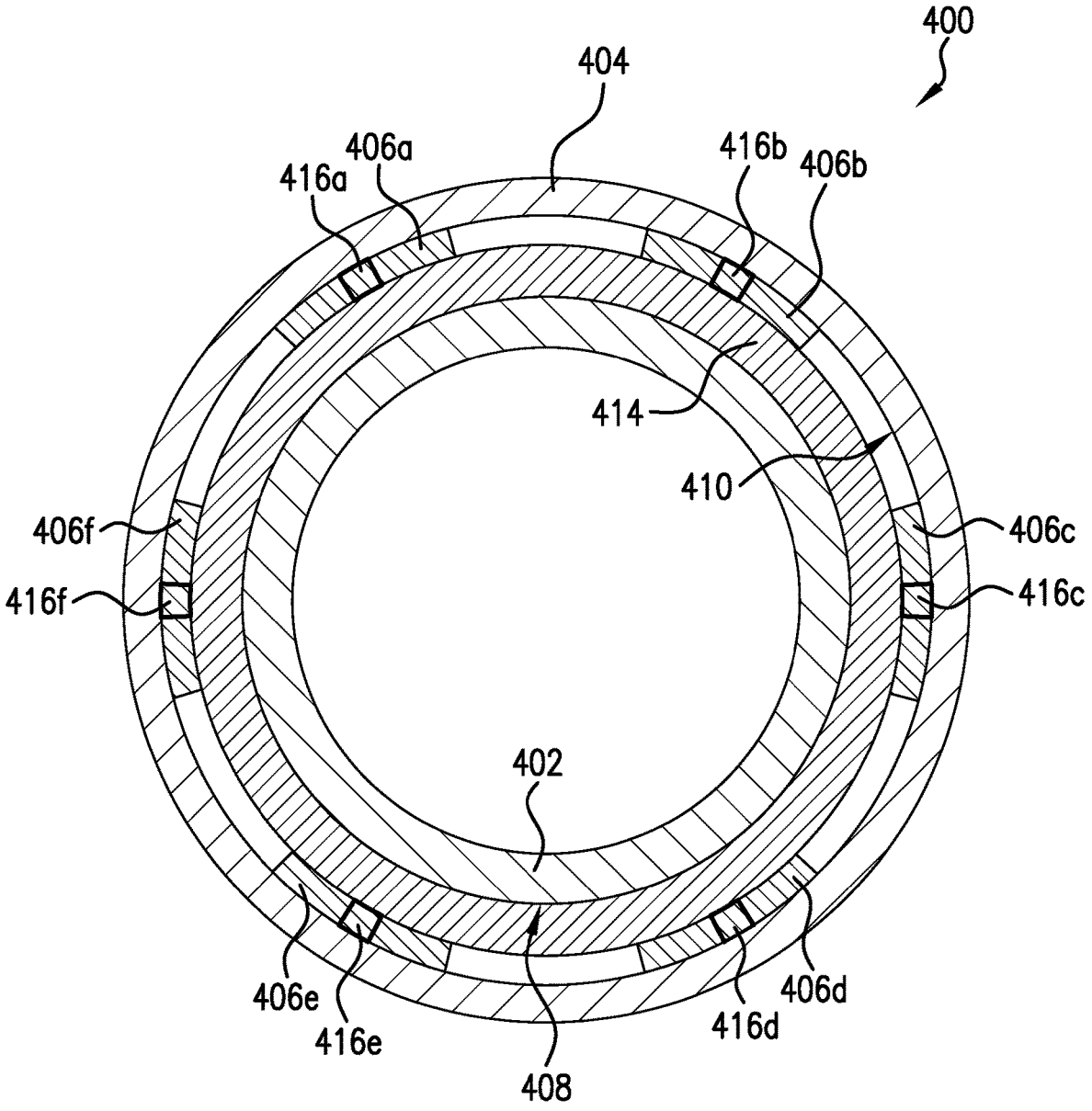
FIG. 4 is a schematic illustration of a portion of a downhole hanger system in accordance with an embodiment of the present disclosure.

Turning now to FIG. 4, an alternative configuration of a downhole hanger system 400 in accordance with an embodiment of the present disclosure is shown. As shown, a first structure 402 is arranged relative to a second structure 404 (i.e., the first structure 402 is arranged within the second structure 404), with the first structure 402 configured to be attached to or hung from the second structure 404 by a composite joint, formed of elements 406*a-f*, with spaces or gaps therebetween, as described above. In some embodiments, the elements 406*a-f* of the composite joint may be formed of material as described above. However, the elements 406*a-f*, in contrast to the above described embodiments, may be activated or fused to form the joint, by mechanisms downhole. As shown, the elements 406*a-f* of the composite joint are arranged on an outer surface 408 of the first structure 402 and is able to be joined to an inner surface 410 of the second structure 404. The material of the elements 406*a-f* of the composite joint may be held in place on the first structure 402 by a ring 414 (or multiple rings, such as a body lock ring and a retaining ring, as described above). In some embodiments, the material of the elements 406*a-f* may be formed of a self-energizing or self-fusing material. That is, the material, once triggered, will undergo an exothermic reaction to generate heat, within the application of external sources of energy.

That is, the material of the elements 406*a-f* of the composite joint is selected for being self-energized. As such, the composite joint of the downhole hanger system 400 of FIG. 4 does not require an external source of energy applied thereto to cause the fusing and joining of materials of the formed joint. That is, the embodiment shown in FIG. 4 does not require a surface energy source and/or downhole high energy application head. Rather, the elements 406*a-f* may include respective embedded activation elements 416*a-f*. The embedded activation elements 416*a-f* may be configured to be triggered downhole and cause the material of the elements 406*a-f* of the composite joint to release heat and exceed the melting temperatures of the elements 406*a-f* of the composite joint and thus form a fused joint with the first structure 402 and the second structure 404. In some such embodiments, a downhole trigger mechanism may be employed to kick start or aid the downhole ignition of the energetic composite. Such triggers may include, for example and without limitation, laser beams, ultrasonic waves, electronic matches, suitable pressure pulses, electric current and/or wireline, etc. That is, any known trigger mechanism for activating elements or components downhole may be used to trigger activation of the embedded activation elements 416*a-f*. In some embodiments, rather than be a discrete or unique activation element, the activation of the material of the elements 406*a-f* of the composite joint may be a trigger of the material itself that comprises the elements 406*a-f*. For example, application of a current or other electrical flow, application of a spark or similar ignition source, etc. may be sufficient to cause the material of the elements 406*a-f* of the composite joint to generate heat and melt to fuse with the first structure 402 and the second structure 404. In another example, transmission of an electric current through a wireline may be used to trigger and activate an electronic match.

The self-energizing or self-fusing composite joint of the present disclosure may be remotely triggered without the need for external energy or heat sources. As such, this configuration may provide for an on-demand solution that merely requires a trigger or activation signal to be transmitted downhole, without the need to transmit or provide any energy or heat from the Earth's surface (e.g., a rig or other surface-based system). Such configuration may reduce the number of components and complexity of the systems, while maintaining the advantages of a slipless hanger described herein. Further, no additional running of components may be necessary for the activation and formation of the composite hanger joint, which can potentially save time, costs, and reduce risks associated with such additional running and deployment of tools and components.

The materials in this configuration may be similar to that shown and described above. That is, the composite joint may be made up of a composition from mixing materials which react to provide heat energy (e.g., via exothermic reaction such as aluminum-nickel oxide, titanium-boron, aluminum-iron oxide, aluminum-coper oxide, aluminum-bismuth oxide, combinations of these materials, etc.) and a joining filler (e.g., tin-, silver-, cadmium-, or lead-based solder material, and/or iron- or nickel-based alloy as joining material) which melt or semi-melt and fuse to join the two metallic components. In some configurations, the composite joint of the present disclosure may include a joining flux, such as ammonium chloride, boron oxide, silicon oxide, or aluminum oxide, to increase a strength of the formed joint. The material of the composite joint, in accordance with embodiments of the present disclosure, is selected to have a lower melt point than the material of the two metal components, and thus the material of the composite joint will melt and fuse with the material of the metal components. In a non-limiting example of the present configuration, the percentage of a braze-to-exothermic reactant would be between 10 to 50 wt %.

Although shown and described herein as a joint formed between a liner (first structure) and casing (second structure), it will be appreciated that the present disclosure can also be used for joining two sections of liner. That is, as applied to the above shown and described embodiments, the casing may be replaced with a liner (second structure), and the inner structure (first structure) with the composite joint on the exterior thereof may be a liner having a smaller diameter than the outer liner. As such, the presently described and illustrated embodiments are merely for illustrative and explanatory purposes and are not limited to the specific configurations thereof.

Figure 5:
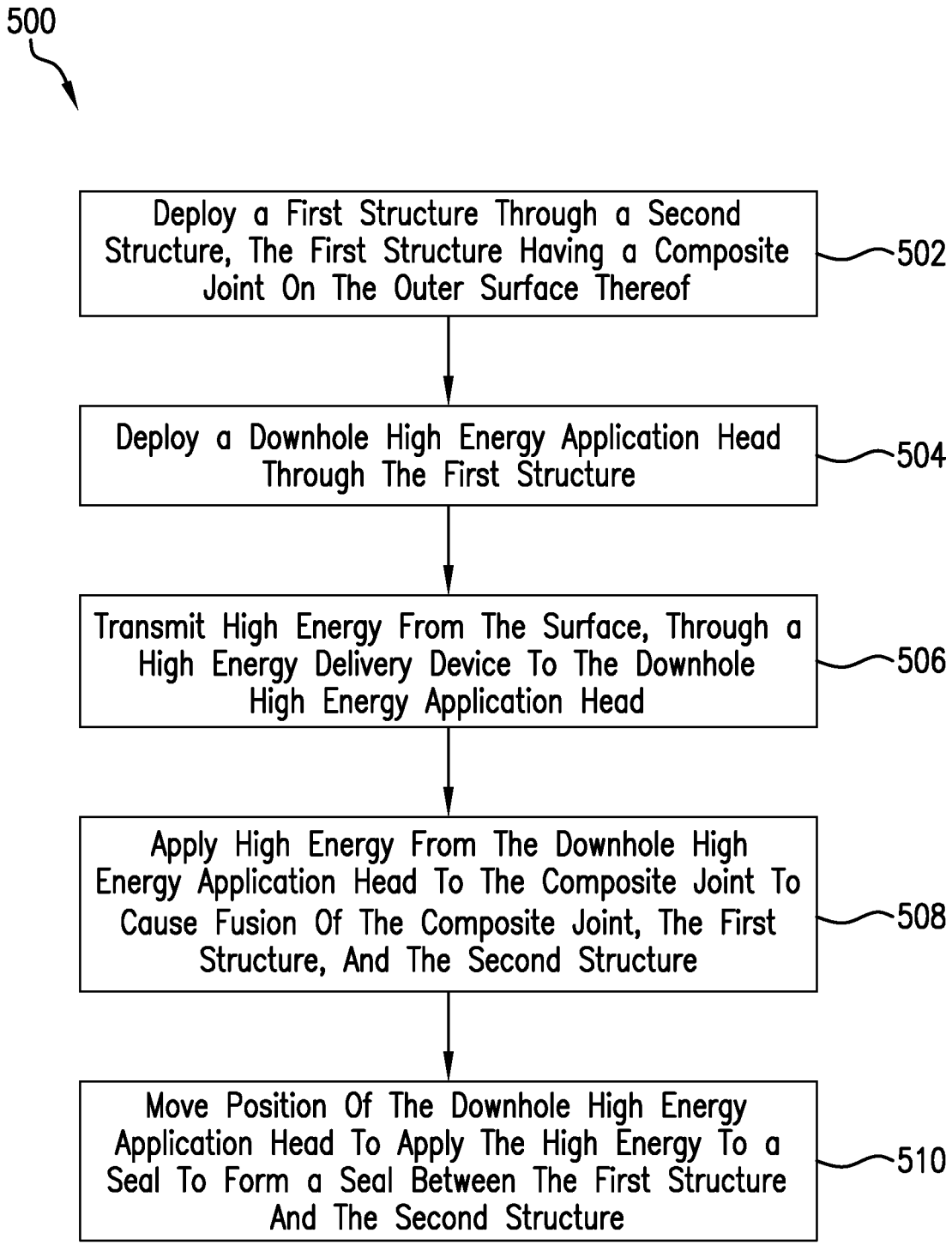
FIG. 5 is a flow process for hanging a first structure from a second structure in downhole environments in accordance with an embodiment of the present disclosure.

Turning now to FIG. 5, a flow process 500 in accordance with an embodiment of the present disclosure is shown. The flow process 500 may be used to hang one structure to another within a downhole environment, with a first structure (e.g., liner) hanging from a second structure (e.g., casing or larger liner). As such, the flow process 500 is described as deploying a first structure having a composite joint on an exterior surface through a second structure, to enable forming a joint between the first structure and the second structure. The configurations of the first and second structures may be similar to that shown and described above, and variations thereon.

At block 502, a first structure is deployed through a second structure within a downhole environment, such as a borehole drilled through a formation. The first structure is configured to be hung from the second structure by a composite joint. The composite joint is formed of one or more sections of composite material arranged on an exterior surface of the first structure. The deployment of the first structure in and through the second structure is made to position the composite joint at a location to which the first and second structures will be fused or joined together by the composite joint.

At block 504, a downhole high energy application head is deployed through the first structure to the location of the composite joint. The downhole high energy application head is disposed on the end of a high energy delivery device, such as a fiber optic cable or other high energy cable. In some embodiments, the high energy delivery device may be integrated into and/or part of a string, such as coiled tubing, wireline, or similar downhole system structures for deploying components thereof. The high energy delivery device operably connects the downhole high energy application head to a surface-based high energy source.

At block 506, the surface-based high energy source generates high energy and transmits such high energy along the high energy delivery device to the downhole high energy application head. The surface-based high energy source may be, without limitation, a millimeter wave (MMW) gyrotron or a fiber laser or kilowatt laser beam source, although other high energy sources and types of high energy may be used without departing from the scope of the present disclosure.

At block 508, the downhole high energy application head is moved in a controlled manner to direct and apply the high energy to the material of the composite joint. The movement may be an axially or longitudinal movement along an axis of a borehole or an axis of the first structure. Further, the movement may be rotational. As such, the downhole high energy application head may be moved to direct and apply the high energy to the material of the composite joint such that the material of the composite joint fuses with at least the second structure (and potentially with the first structure, if not already fused thereto). The fused elements form a downhole hanger joint that can support a high load structure or other suspended load, and the fused joint may have a shear strength of 2 ksi or greater (e.g., 4 ksi or greater).

At block 510, the downhole high energy application head may be moved to another position to apply the high energy to a seal that is arranged on an exterior of the first structure. The application of the high energy to the seal will cause the material of the seal to fuse with at least the second structure (and potentially with the first structure, if not already fused thereto) and thus form a fluid seal. Such seal may be arranged up-hole from the composite joint. It is noted that this step may be performed first, such that the seal is formed prior to the composite joint, which is used to hang the first structure from the second structure.

Figure 6:
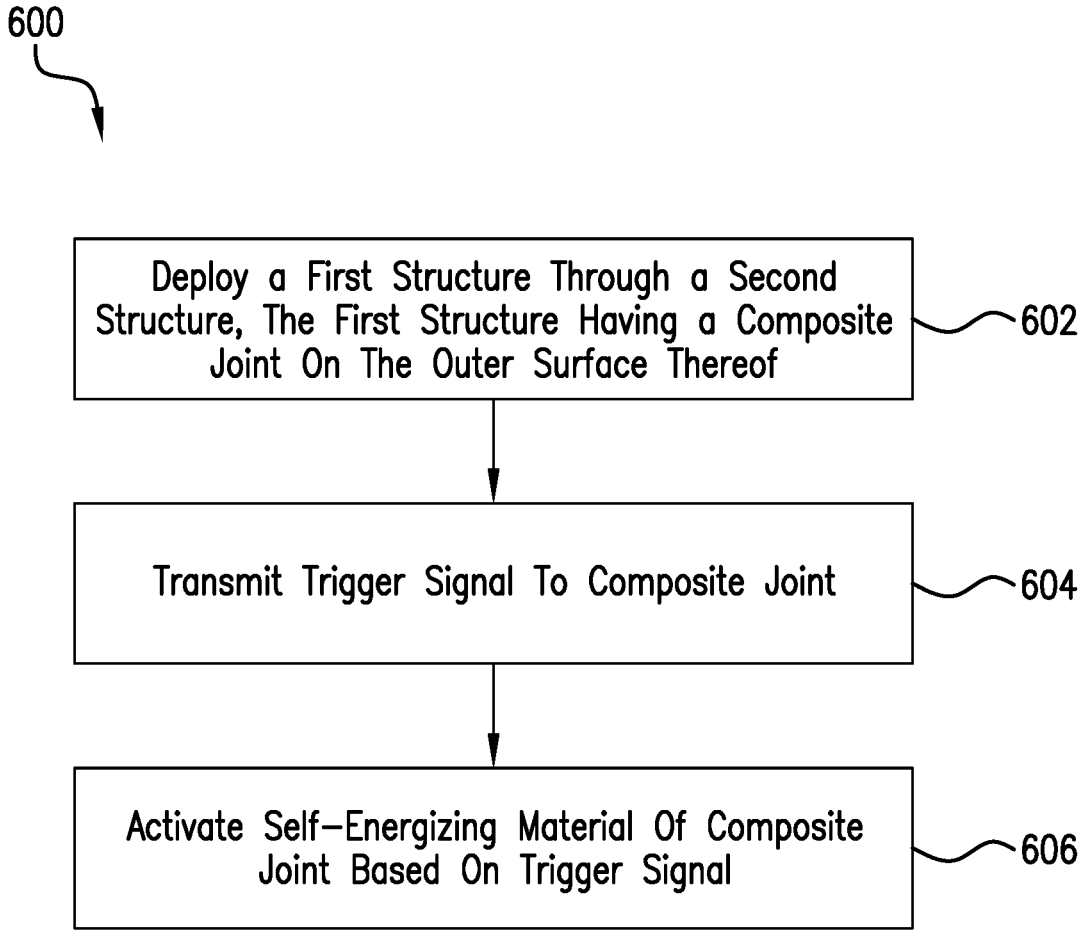
FIG. 6 is a flow process for hanging a first structure from a second structure in downhole environments in accordance with an embodiment of the present disclosure.

Turning now to FIG. 6, a flow process 600 in accordance with an embodiment of the present disclosure is shown. The flow process 600 may be used to hang one structure from another within a downhole environment, with a first structure (e.g., a liner) hanging from a second structure (e.g., casing or larger liner). As such, the flow process 600 is described as deploying a first structure having a composite joint on an exterior surface through a second structure, to enable forming a joint between the first structure and the second structure. The configurations of the first and second structures may be similar to that shown and described above, and variations thereon.

At block 602, a first structure is deployed through a second structure within a downhole environment, such as a borehole drilled through a formation. The first structure is configured to be hung from the second structure by a composite joint. The composite joint is formed of one or more sections of composite material arranged on an exterior surface of the first structure. The deployment of the first structure in and through the second structure is made to position the composite joint at a location to which the first and second structures will be fused or joined together by the composite joint. In this configuration, the composite joint is formed or configured as a self-energizing composite joint. That is, rather than use a downhole high energy application head, a trigger signal may be used to cause the composite joint to self-energize and fuse the first and second structures together.

At block 604, a trigger signal is transmitted from the Earth's surface (e.g., at a rig or other surface-based system) to the composite joint or other triggering operation is performed. The trigger signal may be an electronic signal, a mud-pulse signal, a telemetry signal, electric current, wireline transmission, or other signal as will be appreciated by those of skill in the art. In alternative configurations, the trigger signal may be generated automatically downhole, such as using a proximity sensor or other system that causes the trigger signal to be generated when the composite joint is positioned in a desired location to form the hanger joint (e.g., magnetic or other proximity sensor, trigger, or detection). Other trigger mechanisms can include, without limitation, laser beams, ultrasonic waves, electronic matches, suitable pressure pulses, etc.

At block 606, when the trigger signal is received at the composite joint, the composite joint will self-energize, going through an exothermic reaction which cases the material of the composite joint to melt and fuse with the material of the first and second structures. A similar process may be used to self-energize a seal that provides a fluid seal relative to the composite joint. The fused elements at the composite joint may form a downhole hanger joint that can support a high load structure or other suspended load, and the fused joint may have a shear strength of 2 ksi or greater.

Figure 7C:
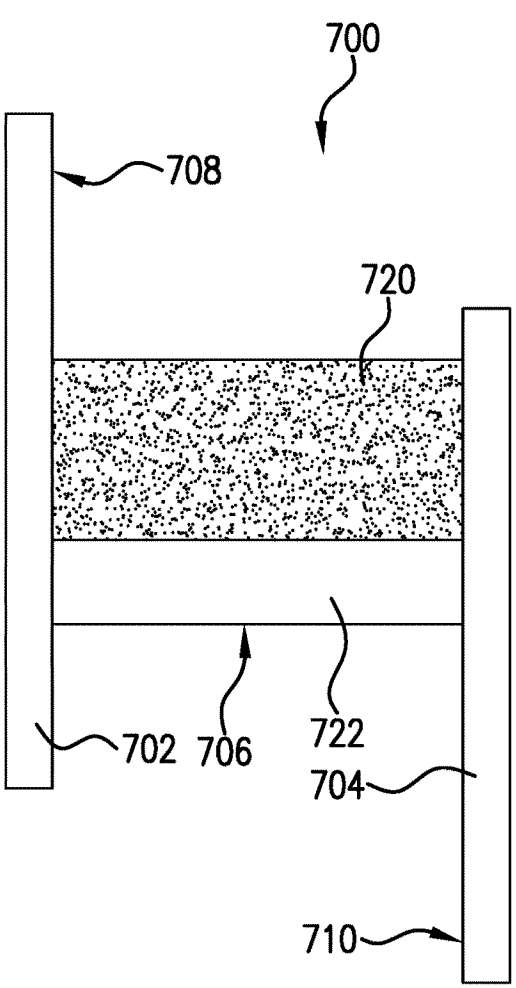
FIG. 7C illustrates a second example arrangement of the elements/compounds of the composite joint of FIG. 7A after activation/bonding illustrating a second in situ joining configuration.
Figure 7B:
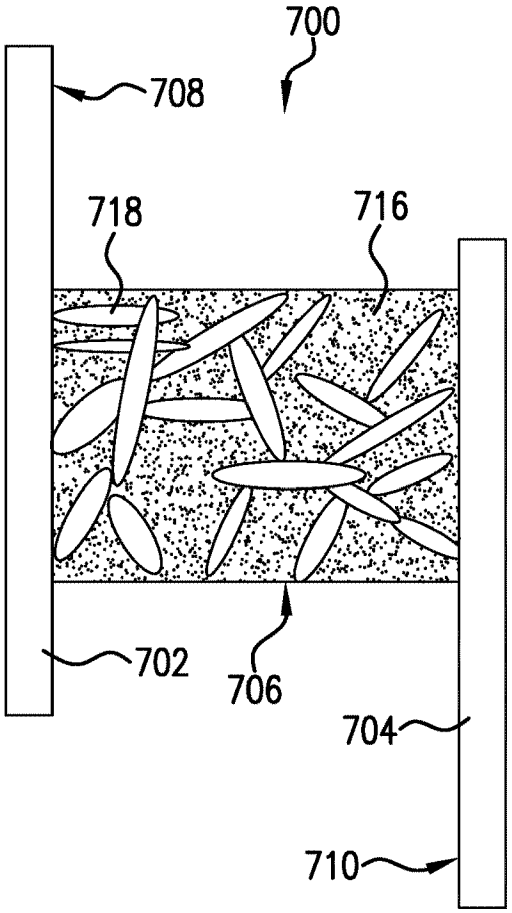
FIG. 7B illustrates a first example arrangement of the elements/compounds of the composite joint of FIG. 7A after activation/bonding illustrating a first in situ joining configuration.
Figure 7A:
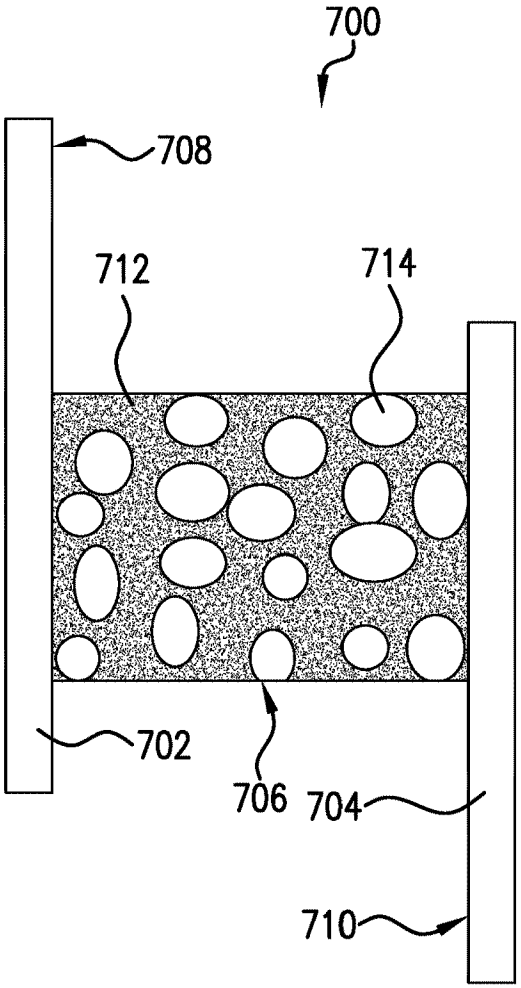
FIG. 7A illustrates an unactivated or unbonded composite joint formed of an exothermic material and a joining filler material in accordance with an embodiment of the present disclosure.

Turning now to FIGS. 7A-7C, schematic illustrations of a downhole hanger system 700 in accordance with an embodiment of the present disclosure are shown. As shown, a first structure 702 is arranged relative to a second structure 704, with the first structure 702 configured to be attached to or hung from the second structure 704 by a composite joint 706. The composite joint 706 may be formed of material as described above and may be activated by application of high energy, as described above. The composite joint 706 is arranged on an outer surface 708 of the first structure 702 and is able to be joined to an inner surface 710 of the second structure 704.

FIG. 7A illustrates an unactivated or unbonded composite joint 706 formed of an exothermic material 712 and a joining filler material 714. FIG. 7B illustrates a first example arrangement of the elements/compounds of the composite joint 706 after activation/bonding (e.g., a first in situ joining configuration). As shown in FIG. 7B, the exothermic material 712 forms a solid composite 716 with an interconnected network of solidified filler 718. FIG. 7C illustrates a second example arrangement of the elements/compounds of the composite joint 706 after activation/bonding (e.g., a second in situ joining configuration). As shown in FIG. 7C, the exothermic material 712 forms a solid composite 720 with a solidified joining filler 722. As illustrated, during the activation and exothermic reaction, with respect to the configuration in FIG. 7C, the exothermic material 712 and the joining filler material 714 separate out into two distinct regions, whereas in the configuration shown in FIG. 7B, the exothermic material 712 and the joining filler material 714 intersperse and are mixed. These illustrative views are merely examples of the distribution of materials of the composite joints of the present disclosure and are not to be limiting. The starting and final distributions of materials/elements/compounds/etc. of the composite joints may be dictated by various factors associated therewith (e.g., chemicals, elements, compounds, orientation and distribution during installation, etc.).

Advantageously, embodiments of the present disclosure enable the formation of a high-load and slip-less hanger joint downhole. The high loads may be achieved by the selection of materials that may be fused to achieve shear strengths of 2 ksi or greater. The slip-less nature is achieved due to the fusing of the materials, rather than relying upon a mechanical hanger configuration, as previously done.

Advantageously, embodiments described herein may eliminate the need for conventional setting tools for hanging structures in downhole environments. Further, a simplified design having fewer moveable components or parts, as described herein, may reduce costs and risks associated with hanging structures in downhole environments. Moreover, the formed fused composite joints may provide for high loading capacity and providing full basic functionality of a hanger joint.

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

Embodiment 1: A downhole hanger system comprising: a first structure; a second structure, wherein the first structure is disposed within the second structure; and a composite joint arranged on an outer surface of the first structure, wherein the composite joint is formed of a material configured to be fused to both the first structure and the second structure and having a shear strength of at least 2 ksi when the material is fused to the outer surface of the first structure and an inner surface of the second structure.

Embodiment 2: The downhole hanger system of any preceding embodiment, wherein the first structure is a liner and the second structure is a casing.

Embodiment 3: The downhole hanger system of any preceding embodiment, wherein the material of the composite joint is a self-energizing material that is configured to be triggered to fuse the first structure to the second structure.

Embodiment 4: The downhole hanger system of any preceding embodiment, further comprising: a surface-based high energy source; a high energy delivery device; and a downhole high energy application head, wherein the high energy delivery device operably connects the surface-based high energy source to the downhole high energy application head.

Embodiment 5: The downhole hanger system of any preceding embodiment, wherein the surface-based high energy source is one of a millimeter wave (MMW) gyrotron and a kilowatt laser beam source.

Embodiment 6: The downhole hanger system of any preceding embodiment, wherein the high energy delivery device is one of an optical fiber and a wave guide.

Embodiment 7: The downhole hanger system of any preceding embodiment, wherein the downhole high energy application head is configured to be moveable both axially relative to an axis of the first structure and rotationally about said axis.

Embodiment 8: The downhole hanger system of any preceding embodiment, wherein the downhole high energy application head comprises a beam collimate lens and a beam focus lens.

Embodiment 9: The downhole hanger system of any preceding embodiment, wherein the composite joint comprises a plurality of discrete elements distributed equally about the outer surface of the first structure.

Embodiment 10: The downhole hanger system of any preceding embodiment, further comprising a seal arranged on the outer surface of the first structure and at a position closer uphole from the composite joint and configured to form a fluid seal uphole of the fused composite joint.

Embodiment 11: The downhole hanger system of any preceding embodiment, wherein the seal is configured to be fused to the outer surface of the first structure and the inner surface of the second structure by application of high energy.

Embodiment 12: The downhole hanger system of any preceding embodiment, wherein the seal is formed of a material that is a self-energizing material configured to be triggered to fuse the first structure to the second structure and form a fluid seal.

Embodiment 13: A method for hanging a first structure from a second structure in a downhole environment, the method comprising: deploying the first structure within the second structure, wherein the first structure includes a composite joint arranged on an outer surface of the first structure; activating the composite joint to fuse the outer surface of the first structure to the second structure, wherein the composite joint is formed of a material configured to be fused to both the first structure and the second structure and having a shear strength of at least 2 ksi when the material is fused to the outer surface of the first structure and an inner surface of the second structure.

Embodiment 14: The method of any preceding embodiment, wherein the material of the composite joint is a self-energizing material that is configured to be triggered to fuse the first structure to the second structure, the method further comprising: performing a triggering operation to activate the composite joint.

Embodiment 15: The method of any preceding embodiment, further comprising: transmitting high energy from a surface-based high energy source, through a high energy delivery device, to a downhole high energy application head to apply the high energy to the material of the composite joint.

Embodiment 16: The method of any preceding embodiment, wherein the surface-based high energy source is one of a millimeter wave (MMW) gyrotron, a kilowatt laser beam source, and an electric current sent by wireline to an electronic-match.

Embodiment 17: The method of any preceding embodiment, wherein the downhole high energy application head is configured to be moveable both axially relative to an axis of the first structure and rotationally about said axis, the method further comprising: controlling movement of the downhole high energy application head to apply the high energy to the material of the composite joint.

Embodiment 18: The method of any preceding embodiment, wherein the composite joint comprises a plurality of discrete elements distributed equally about the outer surface of the first structure.

Embodiment 19: The method of any preceding embodiment, further comprising a seal arranged on the outer surface of the first structure and at a position closer to the Earth's surface than the composite joint and configured to form a fluid seal uphole from the fused composite joint.

Embodiment 20: The method of any preceding embodiment, the method further comprising applying high energy to the seal to fuse to the outer surface of the first structure and the inner surface of the second structure.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A downhole hanger system comprising:

a first structure;

a second structure, wherein the first structure is disposed within the second structure;

a composite joint arranged on an outer surface of the first structure, wherein the composite joint is formed of a material configured to be fused to both the first structure and the second structure and having a shear strength of at least 2 ksi when the material is fused to the outer surface of the first structure and an inner surface of the second structure;

a surface-based high energy source;

a high energy delivery device; and a downhole high energy application head, wherein the high energy delivery device operably connects the surface-based high energy source to the downhole high energy application head to apply energy to the composite joint.

2. The downhole hanger system of claim 1, wherein the first structure is a liner and the second structure is a casing.

3. The downhole hanger system of claim 1, wherein the material of the composite joint is a self-energizing material that is configured to be triggered to fuse the first structure to the second structure.

4. The downhole hanger system of claim 1, wherein the surface-based high energy source is one of a millimeter wave (MMW) gyrotron and a kilowatt laser beam source.

5. The downhole hanger system of claim 1, wherein the high energy delivery device is one of an optical fiber and a wave guide.

6. The downhole hanger system of claim 1, wherein the downhole high energy application head is configured to be moveable both axially relative to an axis of the first structure and rotationally about said axis.

7. The downhole hanger system of claim 1, wherein the downhole high energy application head comprises a beam collimate lens and a beam focus lens.

8. The downhole hanger system of claim 1, wherein the composite joint comprises a plurality of discrete elements distributed equally about the outer surface of the first structure.

9. The downhole hanger system of claim 1, further comprising a seal arranged on the outer surface of the first structure and at a position closer uphole from the composite joint and configured to form a fluid seal uphole of the fused composite joint.

10. The downhole hanger system of claim 9, wherein the seal is configured to be fused to the outer surface of the first structure and the inner surface of the second structure by application of high energy.

11. The downhole hanger system of claim 9, wherein the seal is formed of a material that is a self-energizing material configured to be triggered to fuse the first structure to the second structure and form a fluid seal.

12. A method for hanging a first structure from a second structure in a downhole environment, the method comprising:

deploying the first structure within the second structure, wherein the first structure includes a composite joint arranged on an outer surface of the first structure;

activating the composite joint to fuse the outer surface of the first structure to the second structure, wherein the composite joint is formed of a material configured to be fused to both the first structure and the second structure and having a shear strength of at least 2 ksi when the material is fused to the outer surface of the first structure and an inner surface of the second structure, wherein activating the composite joint comprises transmitting high energy from a surface-based high energy source, through a high energy delivery device, to a downhole high energy application head to apply the high energy to the material of the composite joint.

13. The method of claim 12, wherein the material of the composite joint is a self-energizing material that is configured to be triggered to fuse the first structure to the second structure, the method further comprising:

performing a triggering operation to activate the composite joint.

14. The method of claim 12, wherein the surface-based high energy source is one of a millimeter wave (MMW) gyrotron, a kilowatt laser beam source, and an electric current sent by wireline to an electronic-match.

15. The method of claim 12, wherein the downhole high energy application head is configured to be moveable both axially relative to an axis of the first structure and rotationally about said axis, the method further comprising:

controlling movement of the downhole high energy application head to apply the high energy to the material of the composite joint.

16. The method of claim 12, wherein the composite joint comprises a plurality of discrete elements distributed equally about the outer surface of the first structure.

17. The method of claim 12, further comprising a seal arranged on the outer surface of the first structure and at a position closer to the Earth's surface than the composite joint and configured to form a fluid seal uphole from the fused composite joint.

18. The method of claim 17, the method further comprising applying high energy to the seal to fuse to the outer surface of the first structure and the inner surface of the second structure.

19. A method for hanging a first structure from a second structure in a downhole environment, the method comprising:

deploying the first structure within the second structure in the downhole environment, wherein the first structure includes a composite joint arranged on an outer surface of the first structure, wherein the material of the composite joint comprises a self-energizing material that is configured to be triggered to fuse the first structure to the second structure;

generating a trigger signal when the composite joint is positioned relative to the second structure at a location to hang the first structure from the second structure;

receiving the trigger signal at the composite joint when located in the downhole environment; and activating the composite joint, in response to the trigger signal, to fuse the outer surface of the first structure to the second structure, wherein the composite joint is formed of a material configured to be fused to both the first structure and the second structure and having a shear strength of at least 2 ksi when the material is fused to the outer surface of the first structure and an inner surface of the second structure.

20. The method of claim 19, wherein the trigger signal is transmitted from Earth's surface to the composite joint.

* * * * *